United States Patent [19]

Maisonneuve

[11] Patent Number: 4,513,585

[45] Date of Patent: Apr. 30, 1985

[54] HOT WATER SYSTEM USING A COMPRESSOR

[75] Inventor: Richard Z. Maisonneuve, Shererville, Ind.

[73] Assignee: Manoir International, Inc., South Holland, Ill.

[21] Appl. No.: 224,009

[22] Filed: Jan. 12, 1981

[51] Int. Cl.[3] ..... F25B 27/02

[52] U.S. Cl. ..... 62/238.6

[58] Field of Search ..... 62/238.6, 324.5; 237/2 B, 19

[56] References Cited

U.S. PATENT DOCUMENTS

| | | | |
|---|---|---|---|
| 2,042,812 | 6/1936 | Tull et al. | 62/4 |
| 2,125,842 | 8/1938 | Eggleston | 62/115 |
| 2,668,420 | 2/1954 | Hammell | 62/238.6 |
| 2,700,279 | 1/1955 | Stickel | 62/4 |
| 2,751,761 | 6/1956 | Borgerd | 62/129 |
| 4,041,726 | 8/1977 | Mueller et al. | 62/238 |
| 4,098,092 | 7/1978 | Singh | 62/238 |
| 4,142,678 | 3/1979 | Bottum | 237/2 B |
| 4,168,745 | 9/1979 | Lastinger | 62/238.6 |
| 4,173,872 | 11/1979 | Amthor, Jr. | 62/238 |
| 4,226,606 | 10/1980 | Yaeger et al. | 62/238.6 |
| 4,254,630 | 3/1981 | Geary | 62/238.6 |
| 4,293,093 | 10/1981 | Raymond et al. | 62/238.6 |
| 4,293,323 | 10/1981 | Cohen | 62/324.5 |

*Primary Examiner*—Lloyd L. King

*Attorney, Agent, or Firm*—Fitch, Even, Tabin, Flannery & Welsh

[57] ABSTRACT

Increased efficiency for heating water with a conventional electric water heater tank is obtained with a unit which may be placed next to the side of the hot water tank and readily connected thereto. More specifically, the preferred unit fits along the vertical wall of the conventional water tank and, to this end, includes a narrow upright housing with an inner arcuate wall positioned closely adjacent the cylindrical wall of a water heater tank. The preferred unit has therein a refrigeration apparatus comprising a condenser at the upper end of the unit and closely adjacent the upper end of the tank, a compressor directly therebelow, and an evaporator which withdraws heat from air circulating therearound in a lower chamber. A water circulation system for circulating water through the unit withdraws water through an intake conduit connected to an existing port in the lower end of the tank and pumps water through tubing into a heat transfer relationship with the heated condensed refrigerant to absorb heat therefrom in the condenser unit, and the heated water is returned to the tank through a return conduit connected to an existing safety valve port in the upper end of the tank.

5 Claims, 7 Drawing Figures

22
66
14
10
12
109
64
20
68
92
90
70
26
32
30
74
86
78
61
80

59
58
65
63

HOT WATER SYSTEM USING A COMPRESSOR

The present invention is directed to water heating apparatus and more particularly to apparatus to enhance the efficiency of existing electric water heaters to heat water by condensing refrigerant in a refrigeration apparatus.

Hot water for use in the home is most commonly produced by water heaters in which the heat is produced either by the combustion of gas or by electric resistance elements. Electrical water heaters typically have upright cylindrical tanks, the cylindrical shape of the tank providing the required strength to hold a sufficient reservoir of hot water for domestic use, a primary resistive heating element disposed in the lower end of the tank and a secondary resistive heating element disposed at an upper position within the tank. Cold water is introduced into the bottom region of the tank, typically through a tube which extends downward from an upper water inlet port, and the water, which is heated in the tank, rises by conduction to the upper region of the tank where it is withdrawn for use.

It has heretofore been proposed to use the heat generated in a refrigeration system to aid in the heating of water. This is because the compression and condensation of gas transfers heat through the use of electricity more efficiently than resistance heating elements. Compression and condensing of gas followed by subsequent expension of gas is the cycle which is used in common refrigeration equipment, such as refrigerators or air conditioners. In refrigeration equipment, the cooling which occurs in the evaporator when the condensed refrigerant vaporizes is utilized, while herein, the heat produced in the compressor and condenser is utilized.

Heretofore, compression and condensation of gas to produce heat has not been widely used to heat water for homes because, any energy efficiency achieved was counter-balanced by the cost of the refrigeration apparatus. With the rising cost of energy and particularly electrical energy, the efficiencies achieved by refrigeration apparatus now justify the additional investment in apparatus. The additional apparatus is only justified, of course, if the apparatus transfers heat to the water in an efficient manner to realize the potential energy savings.

A system for converting existing electric water heaters is described in U.S. Pat. No. 4,173,872 in which spiral condenser tubing is inserted into an existing water heater tank. The condenser tubing in the above-mentioned patent is inserted through existing ports in the water heater tank, and space for the tubing is provided by removing the main heating element at the lower end of the tank. If a leak occurs in the condenser tubing, the refrigerant will contaminate the potable water. The upper heating element is preferably left connected to supplement the heat provided by the condenser tubing. The auxiliary unit used to convert the water heater is installed alongside the water heater and occupies a significant amount of floor space. Such a unit is not readily installed by a homeowner, and moreover, often requires floor space unavailable to the homeowner. U.S. Pat. No. 4,173,872 also suggests mounting the refrigeration unit on top of the hot water tank which is generally difficult to do and does not provide adequate support for the unit. Finally, this patent suggests taking out the bottom heating element in FIG. 8 and inserting the water intake and water outlets through the lower port for the lower electrical resistance element. The size of the unit, its electrical system, and the loss of one heating element makes this embodiment less than desirable.

Accordingly, a general object of the invention is to provide a new and improved refrigeration unit in combination with an electrical resistance hot water heating tank.

Another object of the invention is to provide a new and improved refrigeration unit for connection to a hot water electrical resistant tank.

These and other objects and advantages of the invention will become more apparent from the following detailed description of the invention in reference to the accompanying drawings in which.

Figure 1:
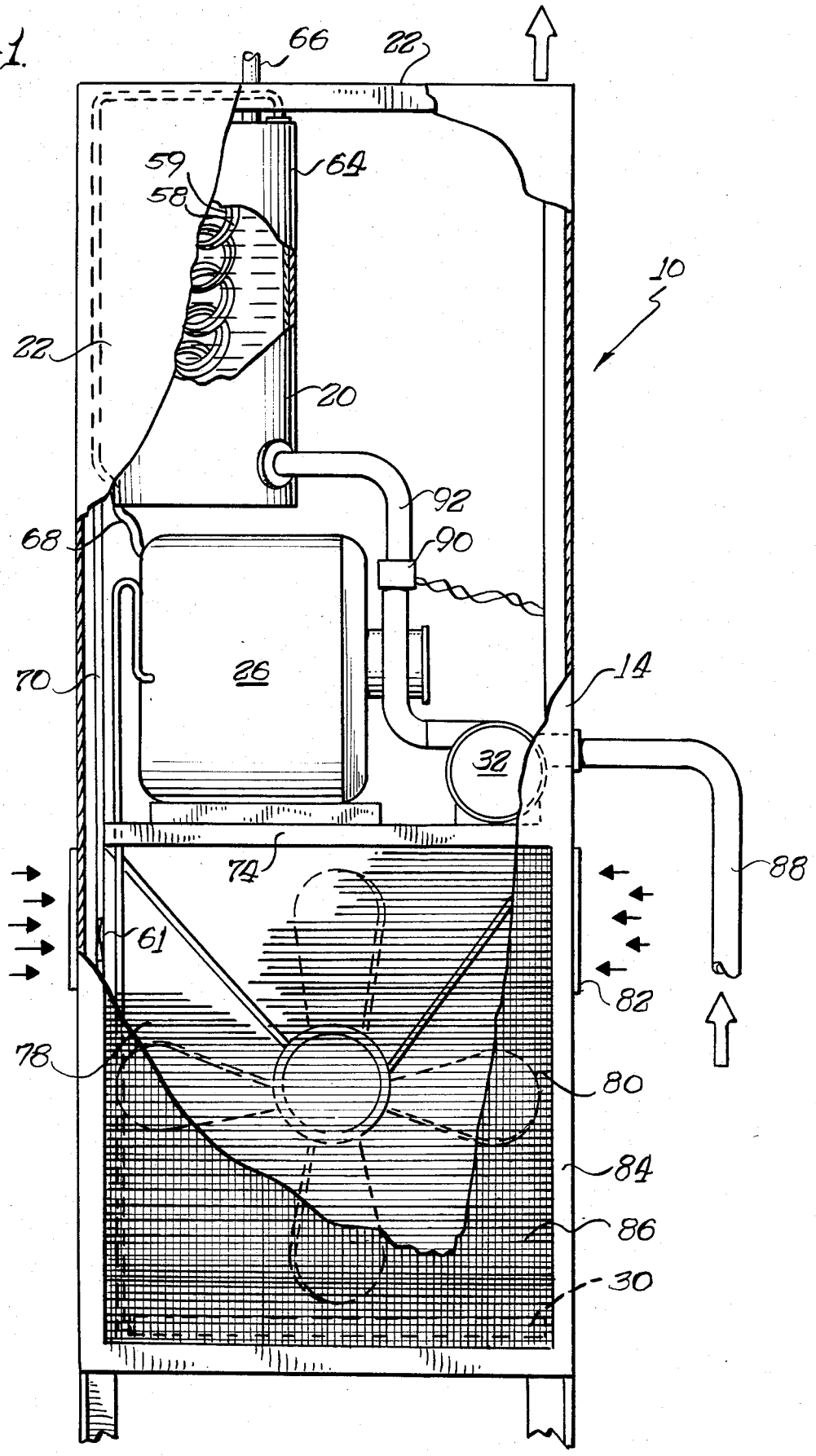
FIG. 1 is an elevation view, partially cut away, of a unit embodying various features of the invention for connection to an existing electric water heater.
Figure 2:
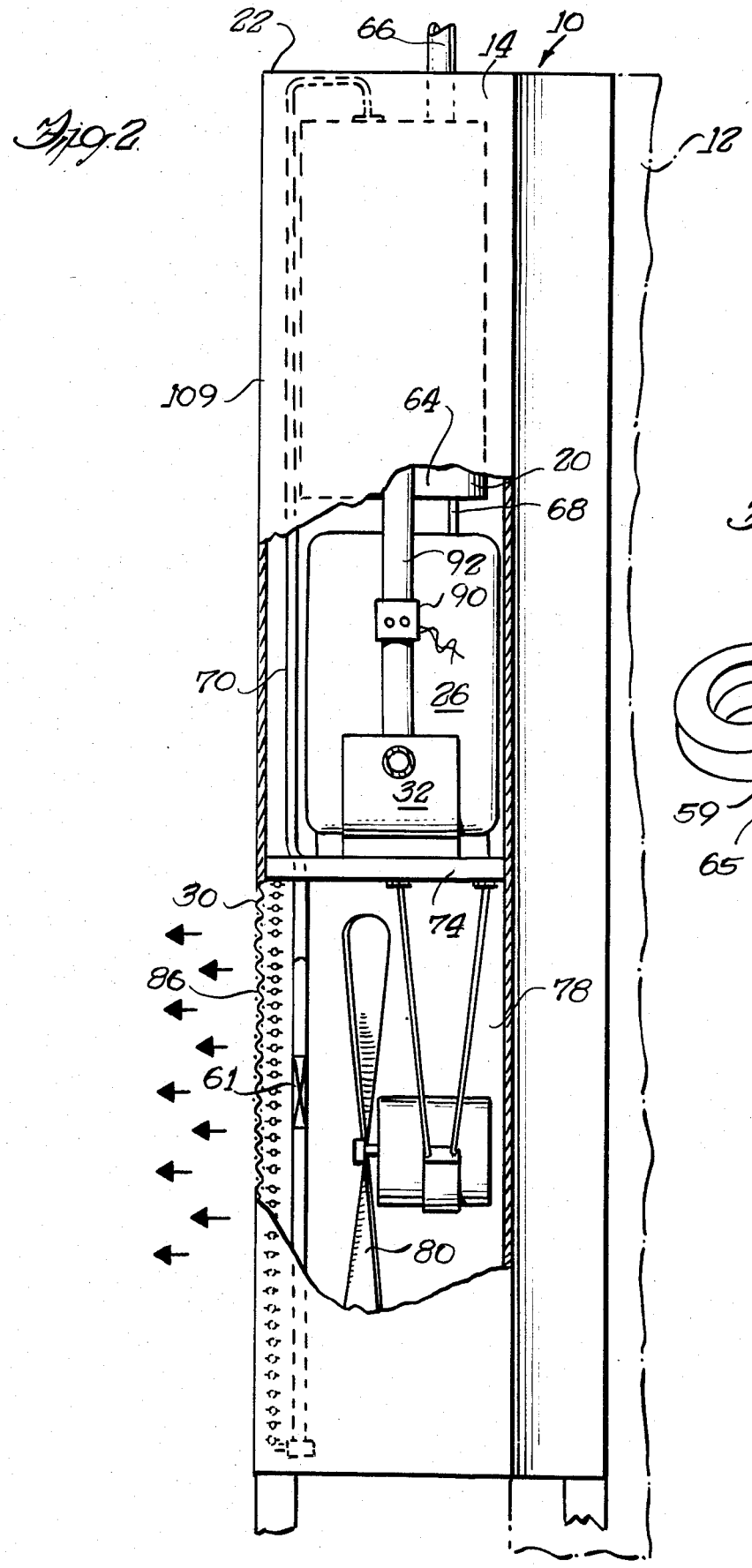
FIG. 2 is a side elevation view, partially cut away, of the unit of FIG. 1.
Figure 6:
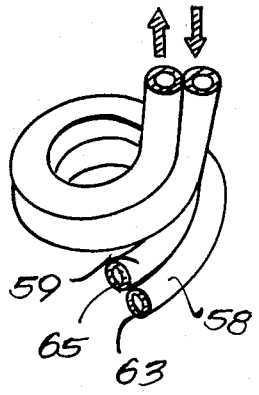
Figure 3A:
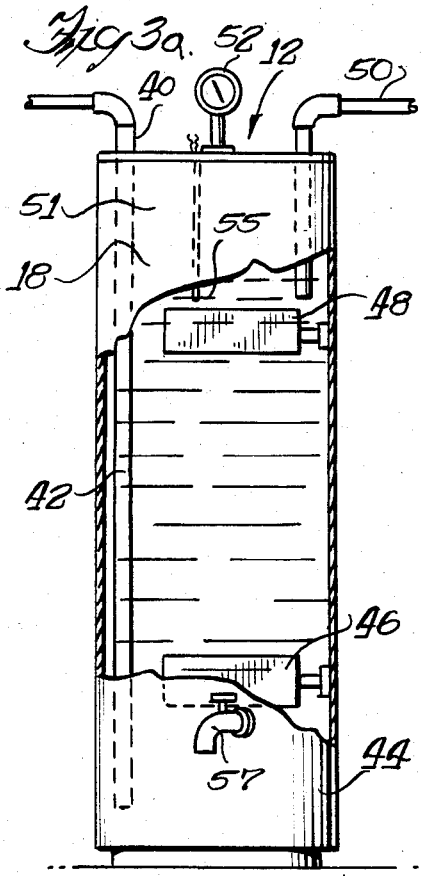
Figure 3B:
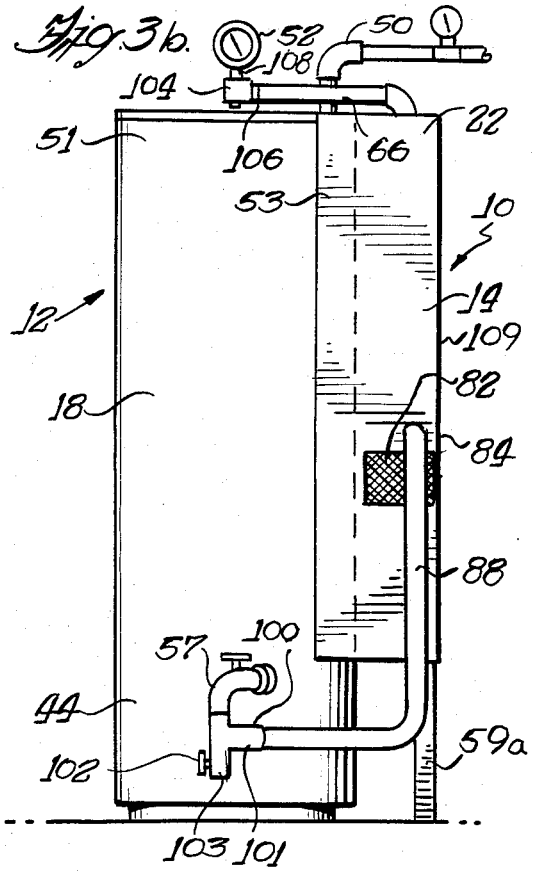
Figure 5:
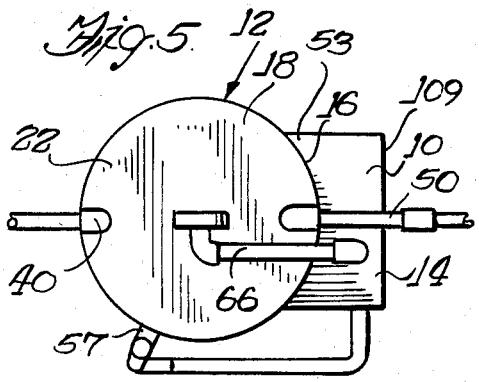
Figure 4:
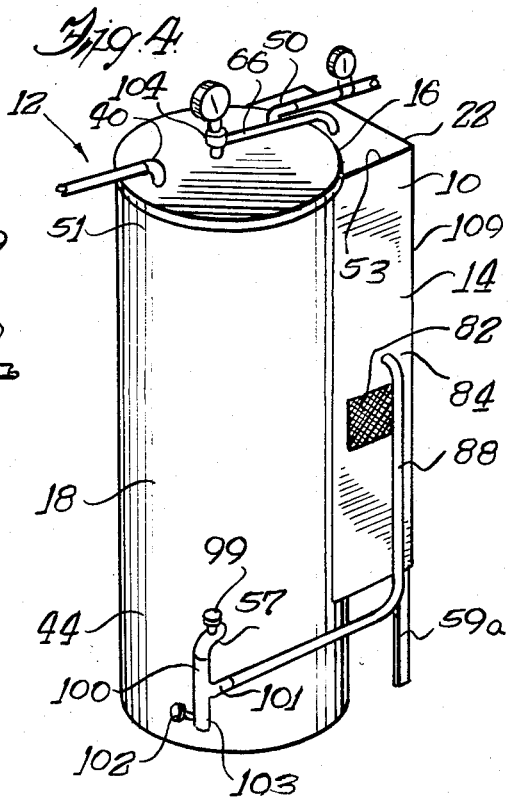

FIG. 3*a* is an elevation view of a conventional electric water heater; FIG. 3*b* is an elevation view of the unit of FIG. 1 connected thereto;

FIG. 4 is a perspective view of the water heater and the unit connected thereto;

FIG. 5 is a plan view of the water heater and the unit connected thereto; and FIG. 6 is an enlarged fragmentary view of refrigerant tubing and water tubing wound in surface contact with each other to define heat exchange surfaces in the condenser.

In accordance with the present invention, the efficiency of electric hot water heaters 12 (FIG. 3*a*) may be increased with the addition of a small, compact and efficient refrigeration unit 10 for heating the water, which may be readily connected by a homeowner or equipment installer. The refrigeration unit will supply much of the heat at a better efficiency than the resistive elements 46 and 48 in the hot water heater, the latter being more effective in quickly heating water to cut the recovery time when large quantities of water are being used. The unit 10 is particularly adapted to be efficient and packaged to fit along side the heater. This is achieved by having the housing 14 for the refrigeration unit formed with an arcuate wall 16 to abut the cylindrical wall of the heater and packing the refrigeration components in a vertical array in an upright and narrow housing. Preferably, the condenser 20 is disposed adjacent the top 22 of the housing 14 so that the heated water has a minimum distance to travel from the condenser 20 into the water heater tank 18. To minimize the refrigerant travel between the compressor 26 and the condenser 20, the compressor is disposed immediately below and closely adjacent to the condenser. Preferably, the electrical system of the auxiliary unit 10 is independent of the electrical system of the existing water heater 12, and intallation of the auxiliary unit does not require the removal or permanent deactivation of existing water heater apparatus thereby allowing the existing heating apparatus to serve as a backup heating system.

So that the invention will be more fully understood, the unit 10 will now be described in greater detail. An electrical water heater 12 of conventional design, which may be adapted by a unit 10 according to the invention, has a cylindrical upright tank 18 which may occupy a small corner of a utility room, closet or basement in a house. Cold water is supplied to the tank 18 through an upper inlet port 40 and through a tube 42 which extends downward therefrom and opens into the lower portion 44 of the tank. A lower resistance heating element 46 (FIG. 3a) provides the primary heating, and the water rises by convection as it is heated. A secondary resistance heating element 48 is located upward in the tank 18. Heated water for domestic use is withdrawn through an outlet conduit 50 in communication with the upper end 51 of the tank 18. A required safety valve 52, to relieve excess pressure, communicates with the tank 18 through a port 54 at the upper end thereof. A thermostat 55 (FIG. 3a) probes the water temperature and is connected to appropriate electrical apparatus to actuate the heating elements 46, 48 according to the temperature of the water in the tank 18. An outlet drain 57 at the lower portion 44 of the tank 18 permits the periodic draining of the tank to remove accumulated crud therefrom.

Most commonly, a water heater 12 will be installed to occupy a minimum of space and to utilize otherwise generally useless space. Accordingly, only a small amount of space will typically be available for installing auxiliary apparatus. Because of the fragility of the tank liners, it is preferred that heavy, vibrating apparatus not be installed on top of water heater tanks. In order to efficiently utilize the small amount of space which will commonly be available adjacent an installed water heater 12, the apparatus in the unit 10 are stacked in the narrow, upright housing 14, which is otherwise generally the shape of an upright rectangular box. The arcuate inner wall 16 is matched to the cylindrical wall of the water heater tank 18 to be positioned closely adjacent thereto and is supported on legs 59a with the upper end 22 of the unit 10 generally at the level of the upper end of the tank 18. The space 53 provided foreward of and to either side of the centerline of the arcuate wall 16 may contain water conduit and electrical apparatus and thus help to minimize the cross-sectional dimensions and reduce the floor space which the unit 10 occupies.

The housing 14 contains conventional refrigeration apparatus where refrigerant, such as freon, circulates in a closed loop where it is compressed in the compressor 26 liquified in the condenser 20, passed through a refrigerant metering device such as an expansion valve 61 and vaporizes in tubing of the evaporator 30 where it withdraws heat from the surrounding air. Heat is transferred in the condenser 20 from the hot liquifying refrigerant in the refrigerant passageways 63 of condenser tubing 58 (FIG. 6) to water passing through water passageways 65 of the tubing 59 in the condenser. In the condenser 20, refrigerant-carrying condenser tubing 58 is coiled in surface contact with water-carrying tubing 59 to define a heat exchange surface therebetween with the water flowing through the water passageway 63 in one direction, and the refrigerant flowing through the refrigerant passageway 65 in the opposite direction. The water tubing 59 and refrigerant tubing 58 are formed of materials which will not be corroded by the contacting liquid and define a double-wall between the water and the refrigerant to insure that the refrigerant will not leak into the potable water. The water tubing 59 and refrigerant-carrying condenser tubing 58 are coiled into a small volume and encased in an insulated container 64 to prevent loss of heat. Various and other forms of heat exchangers in the condenser may be used, preferably a double wall protection will be used so that a leak of the refrigerant will not pass directly into the potable water.

The arrangement of refrigeration apparatus in the unit 10 reduces heat loss by reducing travel distance of heated water from the condenser 20 to the tank and of heated refrigerant from the compressor 26 to the condenser. The condenser 20 is disposed at the upper end of the unit 10 closely adjacent the upper region 51 of the tank 18 to minimize the length of the return conduit 66 through which flows the hottest water of the system into the upper region of the tank. The compressor 26 is disposed directly below the condenser 20 so that a very short refrigerant conduit 68 carries the hot, compressed refrigerant from the compressor to the condenser.

After the refrigerant has passed through the tubing 58 in the condenser 20 and has heated the countercurrent of water passing through the water tubing 59, it flows through a conduit 70 containing the expansion valve 61 to the evaporator 30 at the lower end 72 of the unit 10. The conduit 70 carries the liquified refrigerant to the lower end of the evaporator 30. It is important that the refrigerant be introduced to the lower end of the evaporator 30, because if the liquid refrigerant were introduced at the upper end of the evaporator tubing, trickles of unvaporized liquid refrigerant might run down the evaporator tubing and form a "refrigerant slug" of liquid refrigerant which would reduce the efficiency of the refrigeration apparatus.

The compressor 26 is mounted on a horizontal framework 74 and defines a lower evaporator chamber 78 therebelow containing a blower 80 which draws air through filtered vent openings 82 in the side walls 84 of the chamber, and directs it through a network of evaporator tubing 86 which forms the outer side of the chamber. The evaporator tubing 86, which is cooled by vaporizing refrigerant therein, extracts heat from the air circulating therearound. The air, which is blown outward through the evaporator tubing 86, is cooled and dehumidified, and thus, the water heating unit 10 of the present invention will supplement existing air conditioning, a freature particularly useful in hotter climates where air-conditioning is a more persistent need than heating. Up to a ton of air conditioning will be provided by a conversion unit 10 for a 50-gallon tank during a normal temperate zone summer.

The water pump 32 withdraws colder water from he lower end of the tank through an intake conduit 88, forces it through the water passageways 65 of the water tubing 59 in the condenser 20, and through the return conduit 66 back into the upper region 51 of the tank 18. A thermostat 90, which is disposed in the conduit 92 connecting the water pump 32 with the condenser 20, probes the temperature of water passing through the pump and is connected to appropriate electrical apparatus to actuate the water pump and the refrigeration apparatus according to the temperature of the water in the pump.

In order that the unit 10 be readily attached and installed either by a homeowner directly or with a minimum of expense when using professional installers, the preferred connections between the unit and hot water tank are made without making additional ports in an existing glass-lined water tank. Herein, the unit 10 is connected to existing ports in the tank 18. Herein, a tee 100 (FIG. 4) is connected to the conventional drain pipe 57 having a drain valve 99, the tee having a side elbow 101 to which is secured the intake conduit 88 of the unit's water circulation system, and a lower straight arm 103 having a valve 102 which may be opened to drain the tank and the unit 10. Similarly, a tee 104 (FIG. 3b) is connected between the safety relief valve 52 and the tank, and a side arm 106 of the tee connects the tank 18 with the return conduit 66 from the compressor 20, and an upper arm 108 connects the tank with the safety valve 52 which is necessarily retained in the system.

The preferred electrical system of the auxiliary unit 10 is self-contained and, for domestic purposes, may operate efficiently on 110 volts and 15 amps. Since water heaters typically operate on 220 volts and 30 amps, the operation of the auxiliary unit independently of the water heater electrical system simplifies electrical installation, particularly for a homeowner who prefers to do his own installation. Furthermore, installation is achieved without the removal of existing heating equipment apparatus including its electrical apparatus. This not only facilitates installation which is achieved by a few relatively simple hookups to external water heater apparatus, but permits the retention of both of the conventional resistance elements heating system for a quick recovery.

A typical water heater may be about five feet high and about twenty-six inches in diameter and contain 50 gallons of water. Refrigeration apparatus capable of providing 15,000 BTU's per hour may be encased in an auxiliary unit 10 which measures 8 inches from the centerline of the inner arcuate wall 16 to the outer wall 104 and thus be installed where an 8-inch clearance is available on the side of a water heat 12. It is estimated that the unit 10 will consume about one-third of the electrical energy used by conventional electric water heaters and at present day cost of electricity, the initial investment in the auxiliary unit may be recovered in about three years.

While the invention has been described in terms of a preferred embodiment, modifications obvious to one with ordinary skill in the art may be made without departing from the scope of the invention.

Various features of the invention are set forth in the following claims.

What is claimed is:

1. A conversion unit for an existing electric water heater having a hot water tank comprising:

refrigeration means having a compressor, a refrigerant metering device, an evaporator, and a condenser for a refrigerant, conduit means for connection to an existing port in the tank for withdrawing water therefrom and for conveying water to the condenser, return conduit means for connection to an existing port in the tank for returning heated water to the hot water tank, a thermostatically controlled pump means operable independently of said hot water tank to circulate water through said refrigeration apparatus and said hot water tank, a coiled water conduit in said condenser having a coil for receiving water being pumped through the conduit means and for flowing water through the condenser, a coiled refrigerant conduit having a coil adjacent the water conduit in heat exchange relationship therewith to heat the water being pumped through said coil of said water conduit, each of said water and refrigerant conduits having separate walls so that a leak in the refrigerant conduit wall will not contaminate the water in the water conduit.

2. A unit in accordance with claim 1 in which the refrigerant flows in a downward direction through the coil of the refrigerant conduit and in which the water flows upwardly through the coil of the water conduit.

3. A unit in accordance with claim 1 in which hot water from the conversion unit is discharged from the top thereof to flow to a hot water inlet at the top of the hot water tank, said condenser being located at the top of the unit to reduce the length of the travel of the hot water from the unit to the hot water tank.

4. A unit in accordance with claim 3 in which the compressor is disposed adjacent and below the condenser for providing a short travel path for the refrigerant from the condenser to the compressor and in which the evaporator is disposed adjacent and below the compressor and close thereto for short travel path for the refrigerant from the compressor to the evaporator.

5. A unit in accordance with claim 1 including thermostat control means located adjacent the water pump means in the unit for sensing the temperature of the water as it flows through the pump means.

* * * * *